US008653733B2

(12) United States Patent
Lai

(10) Patent No.: US 8,653,733 B2
(45) Date of Patent: Feb. 18, 2014

(54) LED LAMP TUBE

(75) Inventor: Chyi-Lang Lai, New Taipei (TW)

(73) Assignee: Chicony Power Technology Co., Ltd., New Taipei (TW)

( * ) Notice: Subject to any disclaimer, the term of this patent is extended or adjusted under 35 U.S.C. 154(b) by 321 days.

(21) Appl. No.: 13/085,410

(22) Filed: Apr. 12, 2011

(65) Prior Publication Data

US 2012/0262061 A1 Oct. 18, 2012

(51) Int. Cl.
*H01J 23/18* (2006.01)

(52) U.S. Cl.
USPC ..... 315/5.37

(58) Field of Classification Search
USPC ..... 315/5.37, 32, 33, 51
See application file for complete search history.

(56) References Cited

U.S. PATENT DOCUMENTS 8,405,314 B2 * 3/2013 Jensen ..... 315/51
2012/0043892 A1 * 2/2012 Visser et al. ..... 315/121

* cited by examiner

*Primary Examiner* — Thienvu Tran
(74) *Attorney, Agent, or Firm* — Chun-Ming Shih; HDLS IPR Services

(57) ABSTRACT

The LED lamp tube includes a tube, an LED module, a power supply and a terminal connector. The LED module is accommodated in the tube. The power supply is electrically connected to the LED module and includes a first heating element at one side of the LED module. The terminal connector is electrically connected to the power supply and mechanically connected at one end of the tube.

6 Claims, 5 Drawing Sheets

LED LAMP TUBE

BACKGROUND OF THE INVENTION

1. Technical Field

The invention relates to tubular lamps, particularly to LED lamp tubes.

2. Related Art

With advanced development of light emitting diodes (LEDs) technology and because of the advantages of low power-consuming, long durability, compact size and quick response, LEDs have been replacing conventional lamps. Particularly, LED lamp tubes for replacing conventional fluorescent tubes are a primary subject matter of the LED industry.

A conventional LED lamp tube includes a tube, a lighting module, a power supply and two electric connectors. The lighting module is accommodated in the tube. The lighting module includes a circuit board and LEDs. The LEDs are mounted on the lower side of the circuit board and electrically connected to the circuit board. The power supply is connected to the lighting module and located on the upper side of the circuit board. The two electric connectors are separately fixed at two ends of the tube.

The power supply of the conventional LED lamp tube, however, is located on the upper side of the circuit board. The heat generated from the power supply will affect the LEDs under the circuit board. That is to say, the LEDs will bear heat from themselves and the power supply. Thus durability of the LEDs will be shortened.

SUMMARY OF THE INVENTION

An object of the invention is to provide an LED lamp tube, which can reduce the influence of heat upon the LEDs and extend durability of the LEDs.

To accomplish the above object, the invention provides an LED lamp tube including a tube, an LED module, a power supply and a terminal connector. The LED module is accommodated in the tube. The power supply is electrically connected to the LED module and includes a first heating element at one side of the LED module. The terminal connector is electrically connected to the power supply and mechanically connected at one end of the tube.

DETAILED DESCRIPTION OF THE INVENTION

Figure 1:
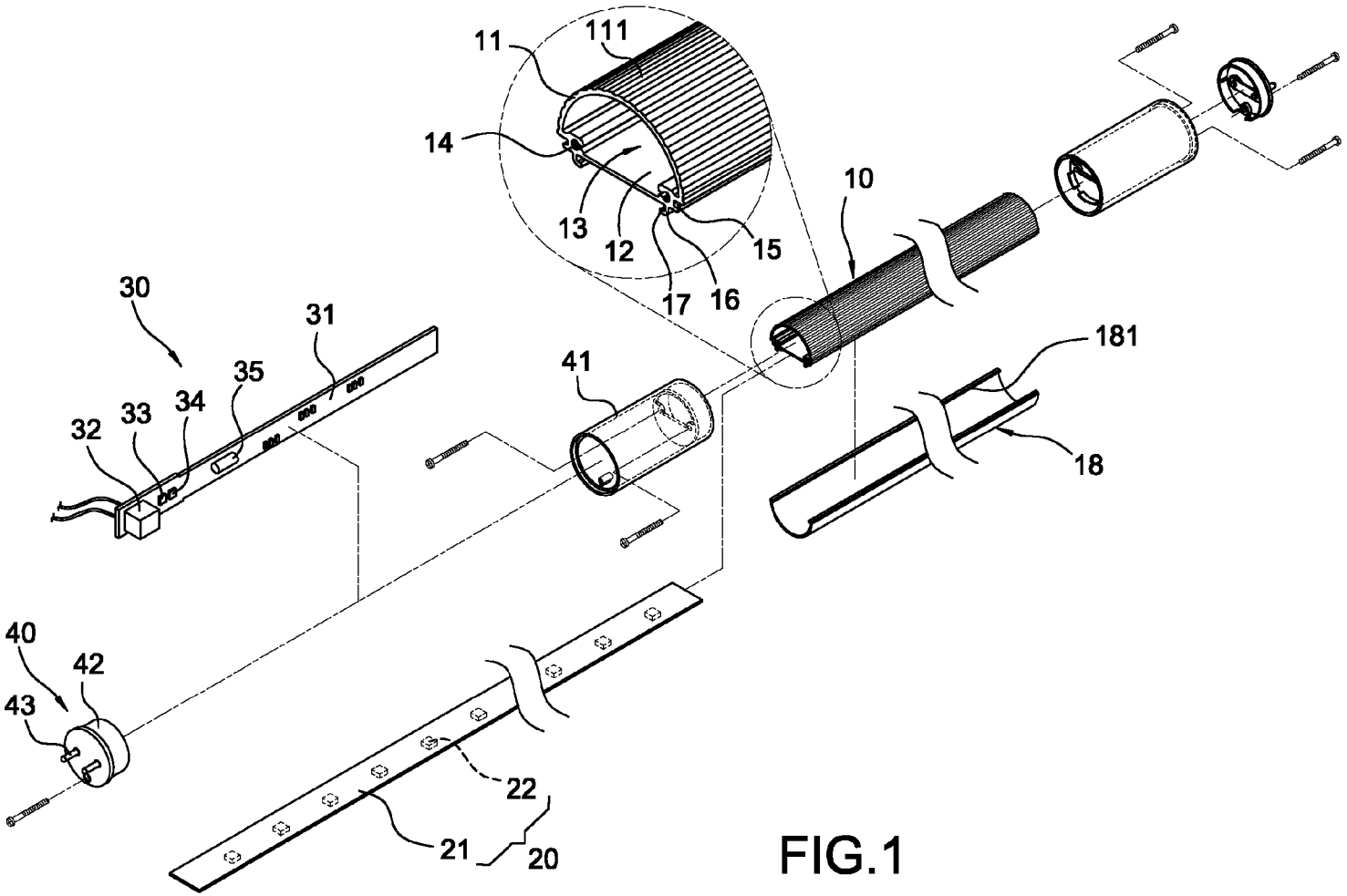
FIG. 1 is an exploded view of the invention.
Figure 2:
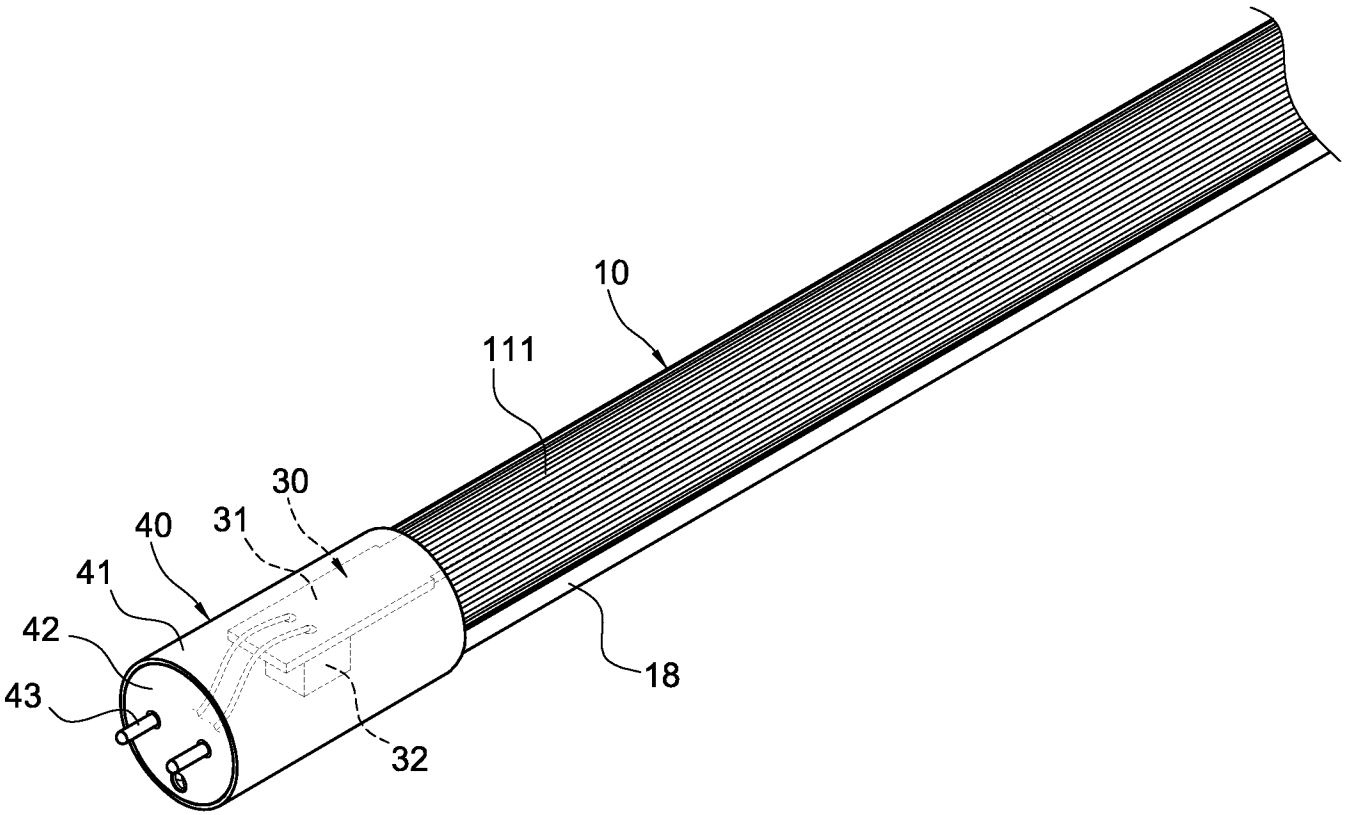
FIG. 2 is an assembled view of the invention.
Figure 3:
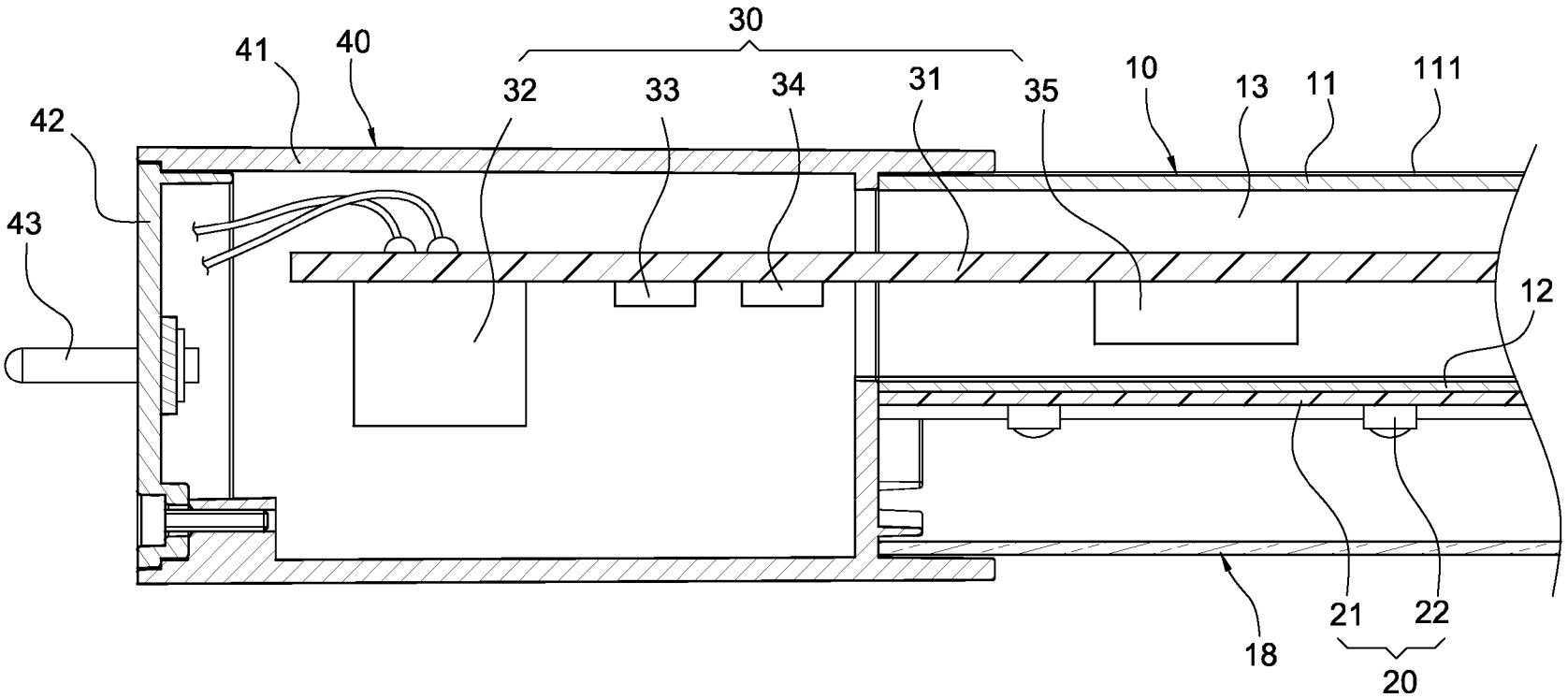
FIG. 3 is a cross-sectional view of the invention.

Please refer to FIGS. 1-3. The LED lamp tube of the invention includes a tube 10, an LED module 20, a power supply 30 and a terminal connector 40.

The tube 10 is composed of a semicircular hood 11 and a semicircular light-permeable cover 18. The semicircular hood 11 is made of aluminum or aluminum alloy. A plate 12 is fastened at an opening of the semicircular hood 11 so that a room 13 is formed in the semicircular hood 11 and the plate 12. The outside of the semicircular hood 11 is formed with a plurality of parallel waved strips 111 for heat dissipation. Two screw holes 14 and two outer grooves 15 are provided at the inside and the outside of the junction of the semicircular hood 11 and plate 12, respectively. A pair of flanges 181 is inwards extended from an opening of the light-permeable cover 18. The light-permeable cover 18 may be engaged with the semicircular hood 11 by inserting the flanges 181 into the outer grooves 15 to form a circular tube. A pair of bent arms 16 is extended from the plate 12 and an inner groove 17 is formed between each of the bent arms 17 and the plate 12.

The LED module 20 includes a circuit board 21 and LEDs 22 mounted thereon. The LEDs are arranged on the circuit board 21 at regular intervals. Two opposite sides of the circuit board 21 are embedded into the inner grooves 17 so as to make the circuit board 21 flatly glued to the plate 12.

The power supply 30 is electrically connected to the LED module 20 and includes a circuitry board 31, a first heating element 32, a second heating element 33, a third heating element 34, a fourth heating element 35 and other electric components. Those heating elements 32, 33, 34, 35 are mounted on the circuitry board 31. The heat generated from the first heating element 32 is higher or equal to the total heat from the other heating elements 33, 34, 35. In the shown embodiment, the first heating element 32 is a transformer and the other heating elements may be a rectifier, capacitor, transistor or filter. The circuitry board 31 is placed in the room 13.

The two terminal connectors 40 are separately fixed at two opposite ends of the tube 10. Each of the terminal connectors 40 includes a cooling pipe 41, a lid 42 and two pins 43. The cooling pipe 41 is made of heat dissipative material. The cooling pipe 41 is put around one end of the tube 10 and is fastened by inserting bolts into the screw holes 14. The lid 42 is mounted on an outer end of the cooling pipe 41. The pins 43 penetrate the lid 32 and electrically connect to the power supply. The heating elements 32, 33, 34 are accommodated in the cooling pipe 41. Thus the cooling pipe 41 will help to dissipate the heat from the heating elements 32, 33, 34.

Figure 4:
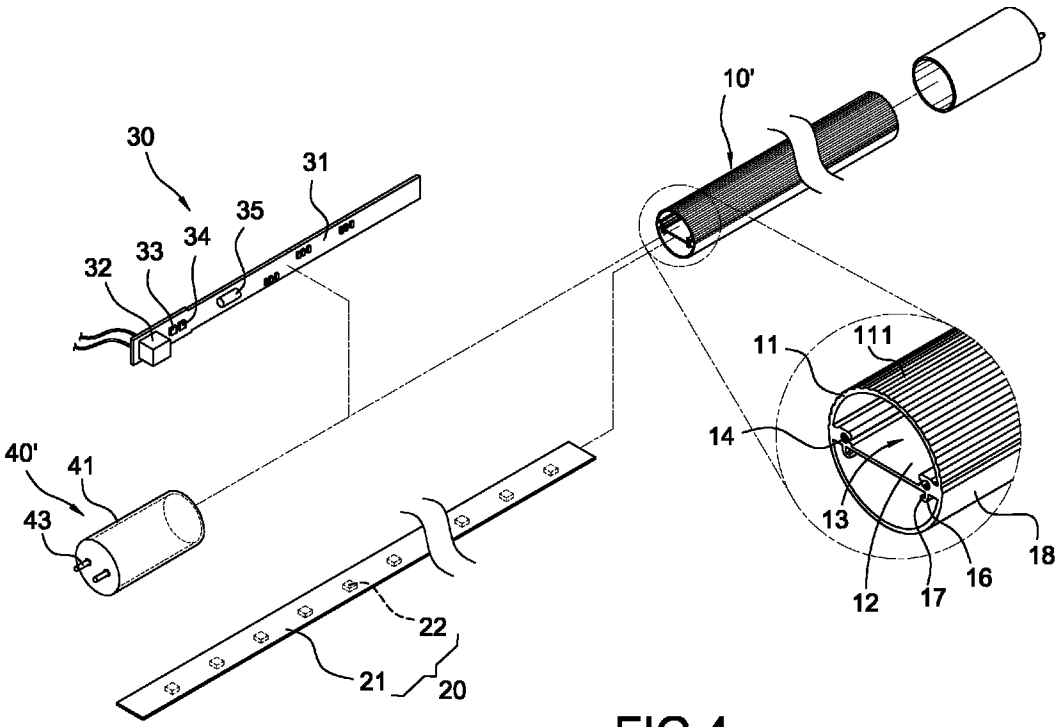
FIG. 4 is an exploded view of another embodiment of the power supply of the invention.

Please refer to FIG. 4, which shows another embodiment of the invention. In this embodiment, the tube 10' is integratedly formed by a semicircular hood 11 and a semicircular light-permeable cover 18 and the terminal connector 40' is composed of a cooling pipe 41 and two pins 43.

Figure 5:
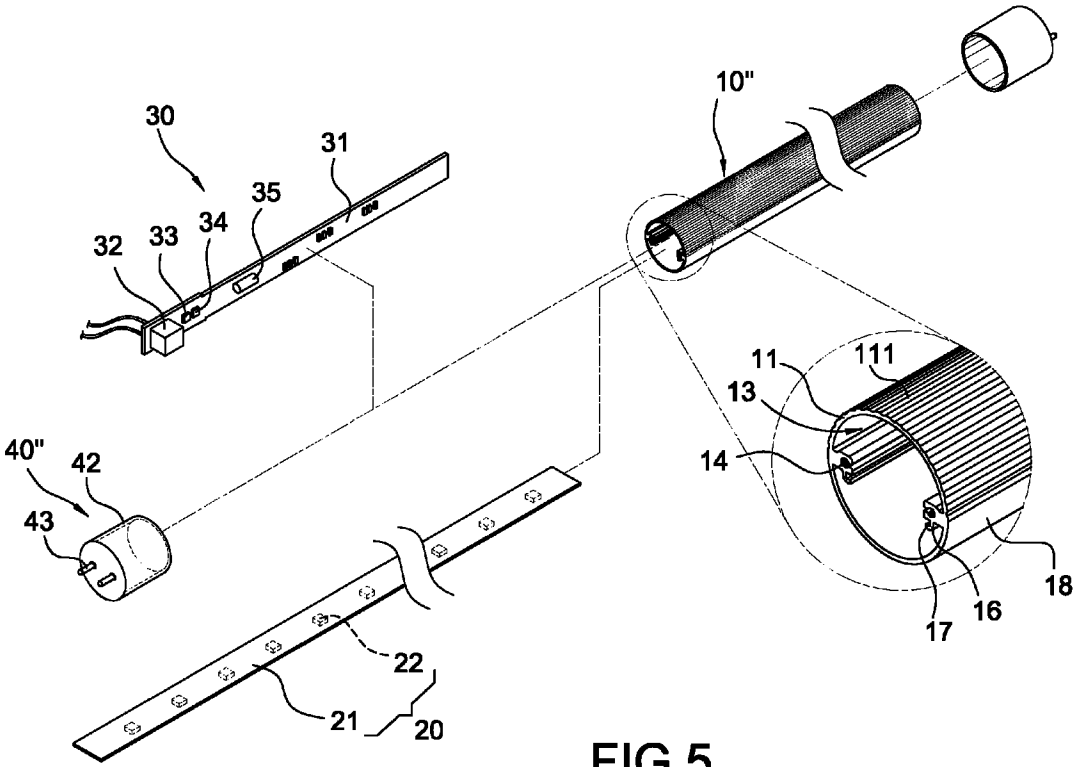
FIG. 5 is an exploded view of still another embodiment of the power supply of the invention.

Please refer to FIG. 5, which shows still another embodiment of the invention. In this embodiment, the tube 10" is integratedly formed by a semicircular hood 11 and a semicircular light-permeable cover 18 and the terminal connector 40" is composed of a lid 42 and two pins 43.

It will be appreciated by persons skilled in the art that the above embodiments have been described by way of example only and not in any limitative sense, and that various alterations and modifications are possible without departure from the scope of the invention as defined by the appended claims. It will be appreciated by persons skilled in the art that the above embodiment has been described by way of example only and not in any limitative sense, and that various alterations and modifications are possible without departure from the scope of the invention as defined by the appended claims.

What is claimed is:

1. A light emitting diode (LED) lamp comprising:

a tube including a semicircular hood, a semicircular light-permeable cover and a plate located between the semicircular hood and the semicircular light-permeable cover;

an LED module accommodated in a first room formed by the plate and the semicircular light-permeable cover;

a power supply electrically connected to the LED module, and including a circuitry board accommodated in a second room formed by the plate and the semicircular hood and a heating element mounted on the circuitry board; and a terminal connector electrically connected to the power supply and including a cooling pipe fixed at one end of the tube for the heating element being located therein, wherein a board is formed between the cooling pipe and the semicircular light-permeable cover to close the first room.

2. The LED lamp of claim 1, wherein the heating element is a transformer.

3. The LED lamp of claim 1, wherein the semicircular hood is formed with a pair of outer grooves and a plurality of waved strips, and a pair of flanges is formed on the semicircular light-permeable cover for being engaged with the outer grooves, respectively.

4. The LED lamp of claim 1, wherein a pair of bent arms is extended from the plate, an inner groove is formed between each of the bent arms and the plate, the LED module includes a circuit board and LEDs mounted thereon, and two opposite sides of the circuit board are engaged with the inner grooves, respectively so as to make the circuit board flatly glued to the plate.

5. The LED lamp of claim 1, wherein the semicircular hood and the semicircular light-permeable cover are integratedly formed.

6. The LED lamp of claim 1, wherein the terminal connector further includes, a lid and two pins, the lid is mounted on an outer end of the cooling pipe, and the pins penetrate the lid.

* * * * *